United States Patent [19]

Simonette

[11] Patent Number: 4,997,302

[45] Date of Patent: Mar. 5, 1991

[54] FOUNTAIN APPLICATOR

[75] Inventor: Dallas W. Simonette, Blaine, Minn.

[73] Assignee: Diversifed Dynamics Corporation, Minneapolis, Minn.

[21] Appl. No.: 482,220

[22] Filed: Feb. 20, 1990

[51] Int. Cl.[5] ..... B65B 3/04; B05C 17/025

[52] U.S. Cl. ..... 401/170; 401/197

[58] Field of Search ..... 401/170, 151, 144, 197, 401/189, 187, 188, 207, 140

[56] References Cited

U.S. PATENT DOCUMENTS

| | | | |
|---|---|---|---|
| 1,428,079 | 9/1922 | Clark | 401/151 |
| 2,805,646 | 9/1957 | Shlesinger | 401/170 |
| 3,554,659 | 1/1971 | Stokes | 401/197 |
| 3,702,739 | 11/1972 | Rentfrow | 401/197 |
| 3,734,149 | 5/1973 | Hansel | 41/350 |
| 4,695,176 | 9/1987 | Simonette | 401/197 |
| 4,732,503 | 3/1988 | Bader | 401/197 |
| 4,810,123 | 3/1989 | Bruggeman | 401/197 |

FOREIGN PATENT DOCUMENTS

| | | | |
|---|---|---|---|
| 3781118 | 7/1923 | Fed. Rep. of Germany | 401/170 |
| 2148154 | 5/1985 | United Kingdom | 401/197 |

*Primary Examiner*—Richard J. Johnson

*Attorney, Agent, or Firm*—Merchant, Gould, Smith Edell, Welter & Schmidt

[57] ABSTRACT

A liquid dispenser that is adapted for use with an applicator to apply liquid coatings. The dispenser has a first tubular housing in which is slidably received a second tubular housing. A liquid tight seal is provided between the two housings to define a liquid reservoir and the second housing has an outlet channel in fluid communication with the reservoir. The second housing has an inlet with a valve which allows fluid flow into the reservoir from an external source but prevents fluid flow from the reservoir when the external source is disconnected. A pressure differential is established between the external fluid source and the reservoir to fill the reservoir.

13 Claims, 2 Drawing Sheets

FOUNTAIN APPLICATOR

BACKGROUND OF THE INVENTION

The present invention relates to a portable fountain applicator for supplying a liquid coating to an applicator head and, in particular, to an applicator useful in applying paint or similar coatings. Specifically, the present invention is an improvement over the fountain applicator shown in U.S. Letters Pat. NO. 4,695,176 that issued to the applicant herein as co-inventor. The prior art applicator handle disclosed in the '176 patent includes a tubular member defining a liquid reservoir. A piston is telescopically received within the tubular member. The handle incorporates a one-way valve into which is inserted a filler tube communicating with the liquid reservoir. The applicator handle is filled by withdrawing the piston from the tubular member creating a suction drawing liquid into the reservoir. In operation, the filler tube is removed from the one-way valve which prevents the loss of fluid from the reservoir through the valve. To dispense the liquid from the reservoir to the applicator head the operator pushes the piston into the tubular member forcing the liquid from the applicator handle.

The present invention provides an applicator that is simpler and easier to use than the applicator disclosed in the '176 patent.

SUMMARY OF THE INVENTION

The present invention is a liquid dispenser adapted to be connected to an applicator head that includes a first generally tubular housing with a second generally tubular housing telescopically received within one end of the first housing. A liquid tight seal is provided between the first and second housings to define a liquid reservoir. A closed end of the first tubular housing is provided with a sealing means to prevent liquid flow from the reservoir and for receiving a tube for filling the reservoir with liquid. The second housing has an outlet channel for the discharge of liquid as the second housing slides axially within the first housing. In the preferred embodiment a valve is disposed in the outlet channel to selectively open and close the channel. The applicator is particularly adapted for use with a lid designed to snap fit onto a container. Mounted in the lid is a fill tube. The applicator is filled by inserting the fill tube through the sealing means in the end of the first housing and withdrawing the second housing to a fully extended position creating a negative pressure or suction that causes the liquid to be drawn from the container to fill the expanding reservoir in the applicator. The operator can easily control the flow of liquid to the applicator head. The operator typically holds the second housing during the coating operation and can cause additional liquid to flow to the applicator head by simply pressing the head against a stationary surface such as the wall or ceiling being coated. This causes the second housing to telescope inwardly with respect to the first housing creating a positive pressure thereby forcing liquid through the outlet channel. The advantages of the present invention will become more apparent with reference to the accompanying drawings, detailed description of the preferred embodiments and claims.

DETAILED DESCRIPTION OF THE PREFERRED EMBODIMENT

Figure 1:
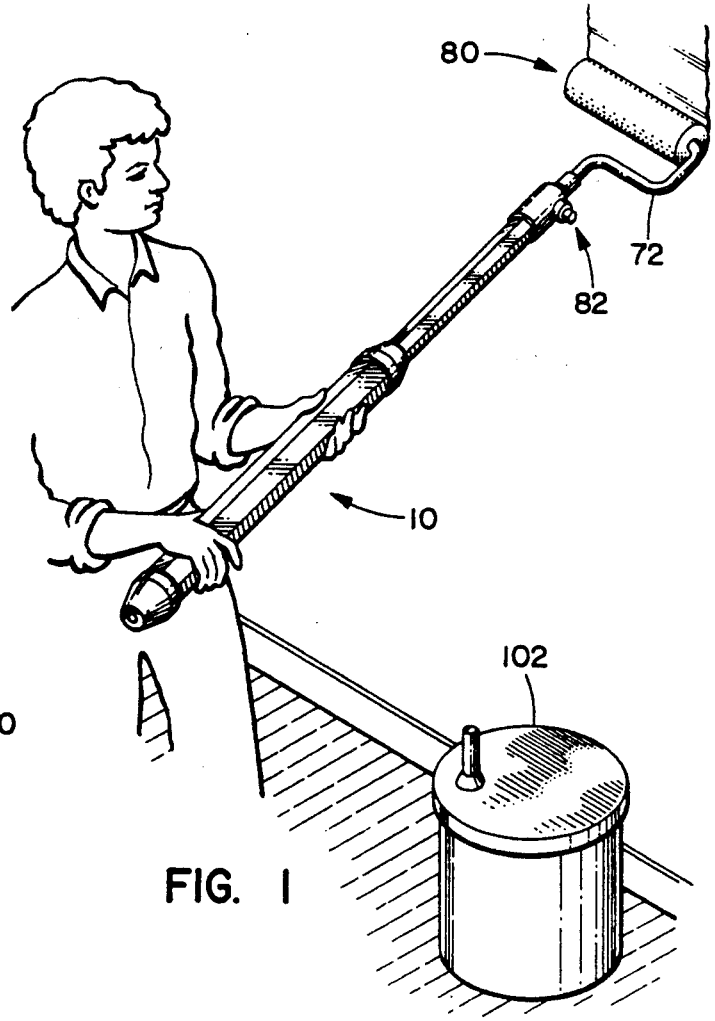
FIG. 1 illustrates the use of the liquid dispenser of the present invention.

Referring to the drawings, wherein like numerals represent like parts throughout the several views, the applicator of the present invention is indicated generally at 10. It includes a generally tubular first housing member 12 having a body 14 and end members 16 and 18. End member 16 is generally frusto-conical in shape with its outer surface sloping inwardly toward a central longitudinal axis of applicator 10 from the juncture (designated generally at 20) of end member 16 with housing member 12 toward its end 22. Body 14 and end member 16 are typically made of a suitable plastic material and are joined at 20 by the known process of spin welding. In the practice of this process one of the two parts is held stationary while the other is spun at sufficient speed to heat the plastic material of the two parts through frictional engagement causing the parts to fuse together eliminating the need for a separate bonding agent. End member 18 is similarly bonded to body 14. It should be understood, however, that it is within the spirit and scope of the present invention to secure end members 16 and 18 to body 14 by other conventional adhesive processes.

End member 16 has a central channel in which is received a duckbill-style check valve 26. Valve 26 has a flange 28 mounted within a recess 30 formed in 22 that communicates with channel 24. Valve 26 is designed to permit fluid flow into applicator 10 and to prevent fluid from flowing outward through channel 24. Also disposed within recess 30 and mating with flange 28 may be a drip sponge 32 with a central opening allowing a fill tube, which will be described in more detail hereafter, to be inserted into valve 26.

End member 18 also has exterior side walls that slope inwardly toward a central axis of applicator 10 from body 14 toward an open end 34 of housing member 12. A second generally tubular housing member 36 is received within housing member 12. Second housing member 36 has a generally tubular body 38 and end members 40 and 42. End member 42 is generally tubular with a side wall 44, and a head portion 46. Head portion 46 has a recess at 48 and a truncated tube 50 communicating with recess 48 and extending axially along the body of housing member 36. An annular recess is formed in the outside surface of head portion 46 which receives a sealing gasket 52. Gasket 52 provides a liquid tight seal against the inner wall of first housing member and may, for example, be an 0-ring. Side wall 42 extends from head portion 46 with a first section 54 and terminating in a second section 56 having an outside diameter slightly larger than the outside diameter of section 54. Body 38 of second housing member 36 is received within end member 42 and bonded to side wall 44. A liquid discharge tube 58 is disposed concentrically with respect to body 38 of second housing member 36 and is affixed at one end to truncated tube 50 and at its opposite end to end member 40. An annular chamber as indicated at 60 is defined between body 38 and liquid discharge tube 58. Tube 58 defines a passageway 62 through which liquid in applicator 10 is dispensed.

End member 40 has a head portion 64 from which extends a tubular side wall 66. Body 38 of second housing member 36 is bonded to side wall 66 and an end surface 68 of head portion 64. Discharge tube 58 is also bonded to surface 68. Head portion 64 has a centrally disposed passageway 70 that communicates with passageway 62. Passageway 70 has an enlarged segment adapted to receive a feed tube 72. In order to secure feed tube 72 in passageway 70 an externally threaded nipple portion 74 is provided. Feed tube 72 has a retaining ring 76 and an internally threaded retaining nut 78 fits over ring 76 engaging nipple portion 74 securing tube 72 and thereby securing an applicator head 80 to applicator 10. Applicator 80 is illustrated in the drawings as having a roller-type head. The roller-type head may be of any conventional design such as those sold by the Power-Flow Products Corporation of Minneapolis, Minn. It is also understood that applicator head 80 could also be of other conventional prior art design such as a paint pad or brush.

Figure 3:
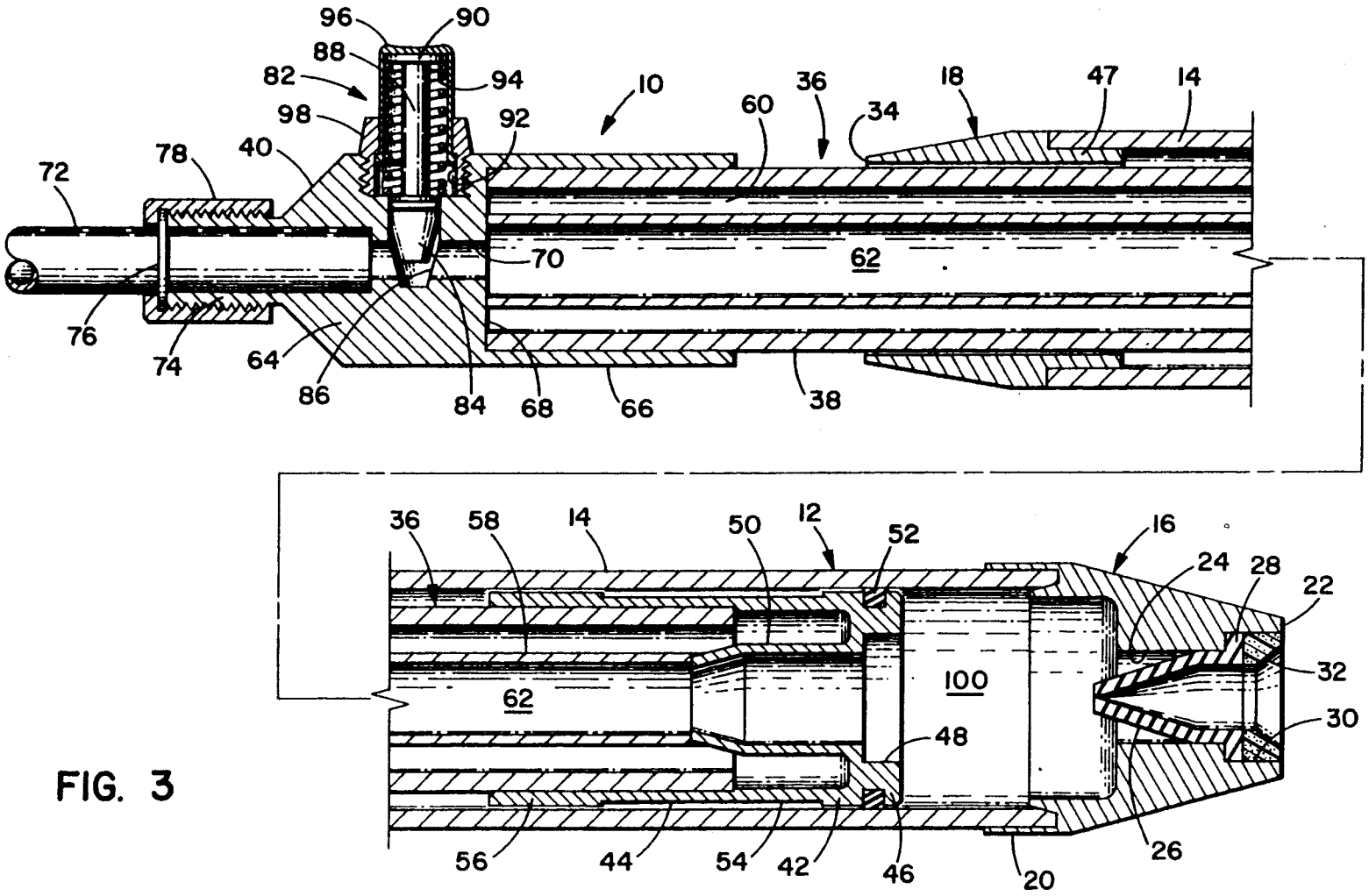
FIG. 3 is an enlarged cross-sectional view of the dispenser of the present invention.

Mounted on head portion 64 is a valve 82 that may be selectively positioned to open or close passageway 70. Valve 82 includes a valve head 84 disposed within a passageway 86 that communicates with passageway 70 and is orthogonal with respect thereto. Extending from head 84 is a valve stem 88 that terminates in a disk 90. Passageway 86 is enlarged as at 92 to receive a biasing spring 94. Spring 94 engages disk 90 normally biasing valve 82 to the position shown in FIG. 3 where passageway 70 is open allowing for fluid flow from passageway 62 into feed tube 72. A push button 96 receives valve stem 88 and spring 94. At the enlarged portion 92 of passageway 86 end member 40 is internally threaded to receive a nut 98 which captures button 96 and allows reciprocal movement of button 96 within passageway 86. When button 96 is depressed against the force of spring 94 valve head 84 seats within passageway 70 closing passageway 70 preventing the flow of fluid between passageway 62 and feed tube 72.

A liquid reservoir 100 of varying capacity depending upon the position of housing member 36 within housing member 12 is defined by head portion 46, body 14 and end member 16. Liquid reservoir 100 is in fluid communication via recess 48 and truncated tube 50 with passageway 62.

Figure 2:
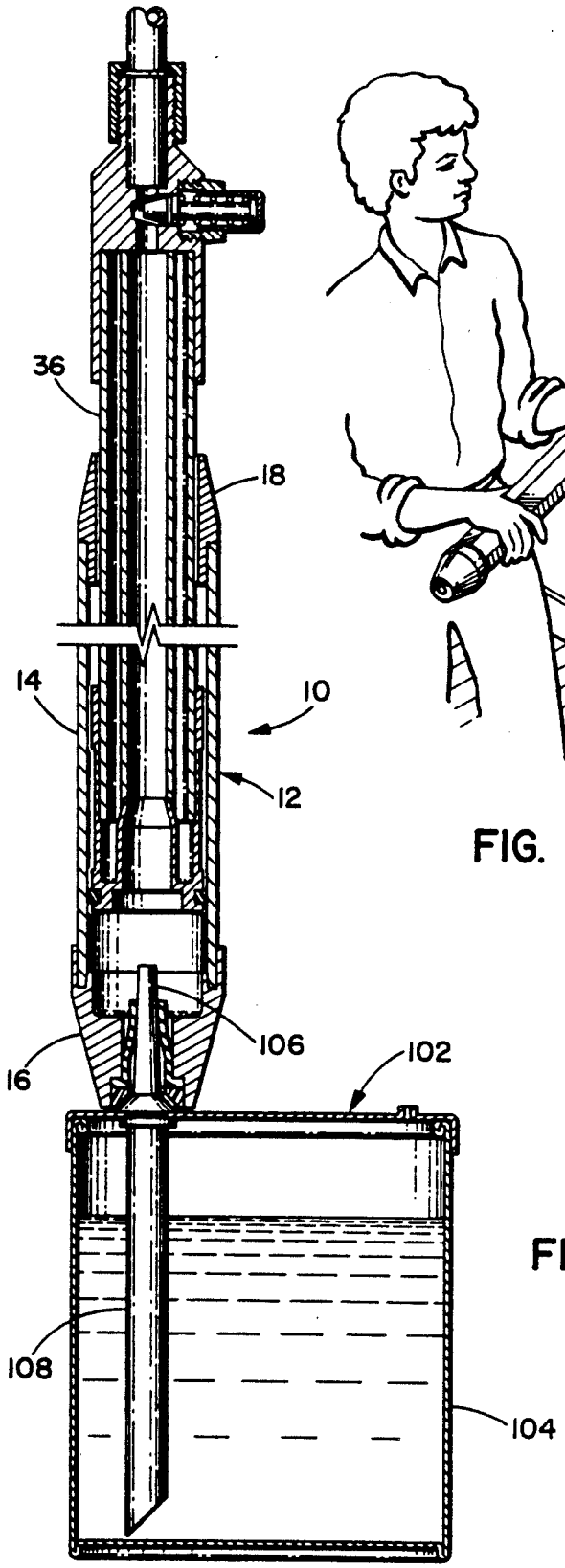
FIG. 2 is a cross-sectional view of the dispenser and associated fill lid and liquid container.

Associated with applicator 10 is a filler lid 102 sized to snap fit onto a conventional liquid container 104. Lid 102 has a fill tube 106 extending upward therefrom and adapted to be inserted into check valve 26 as shown in FIG. 2. Extending from fill tube 106 into container 104 is a suction tube 108 which has a length sufficient to reach the bottom of container 104. The bottom end of tube 108 has a diagonal cut to prevent the suction from drawing the bottom of container 104 against tube 108 thereby shutting off the flow of fluid.

In operation applicator 10 is used as follows. To fill applicator 10 fill tube 106 is inserted into valve 26 into reservoir 100. The operator depresses button 96 causing valve 82 to close passageway 70. Second housing member 36 is then extended upward from housing member 12 creating a negative pressure or suction that draws liquid from container 104 into reservoir 100 through fill tube 106. The reservoir is filled and the outward travel of housing member 36 terminates when section 56, of side wall 44 abuts against an annular stop 47 integrally formed with end member 18. When fill tube 106 is withdrawn from valve 26 liquid is prevented from flowing out from end member 16. To dispense the liquid from applicator 10 the push button 96 must be released opening passageway 70. Liquid is dispensed by telescoping housing member 36 into housing member 12 creating a positive pressure forcing liquid from reservoir 100 through passageway 62 to applicator head 80. The telescoping action can be accomplished, for example, by the operator holding housing member 12 as shown in FIG. 1 and pushing applicator head 80 against the wall or any other stationary surface. Thus, while the operator is applying the liquid coating he has continuous control over the replenishment of liquid to applicator head 80. After an appropriate amount of liquid has been dispensed, if any is left in applicator 10 it can be returned to container 104 in the following manner. The operator simply depresses push button 96, causing valve 82 to close passageway 70. Then telescoping of housing member 36 into housing member 12 with filler tube 106 inserted into valve 26 will cause the fluid in reservoir 100 to be forced back into container 104 through tubes 106 and 108.

When the coating operation is finished applicator 10 can be readily cleaned by attaching filler lid 102 to a container of cleaning solution and filling applicator 10 in the same manner as previously described followed by discharging the cleaning solution through the applicator head 80 and/or reverse flow through fill tube 106.

From the above description it will be appreciated that the present invention comprises an improvement over the prior fountain type applicators. The applicator can be easily filled and the dispensing of liquid from the applicator is greatly simplified since the operator need only press the applicator head against the surface that he or she is coating in order to feed additional liquid to the coating head.

What is claimed is:

1. A liquid dispenser adapted for use with an applicator for applying liquid coatings comprising:

a first generally tubular housing;

a second generally tubular housing slidably received within said first housing;

means for providing a liquid tight seal between said first and second housings, said first and second housings defining a liquid reservoir, said second housing having an outlet channel communicating with said reservoir for the dispensing of liquid to said applicator as said second housing slides axially within said first housing;

means for refilling said liquid reservoir comprising an inlet means in said second housing providing fluid communication between an external fluid source and the reservoir and valve means disposed ,in said inlet means for preventing fluid flow through said inlet means when said refill means is not connected to the external source and for providing fluid communication between the reservoir and the external source when the external source is connected to said inlet means;

means for establishing a pressure differential between the reservoir and the external fluid source whereby fluid is withdrawn from the source into the reservoir.

2. A liquid dispenser in accordance with claim 1 wherein said valve means is adapted to receive a fill tube and wherein said valve means automatically blocks said inlet means preventing fluid flow therethrough when the fill tube is not inserted into said valve means.

3. A liquid dispenser in accordance with claim 2 wherein said valve means comprises a duckbill-type check valve.

4. A liquid dispenser in accordance with claim 1 wherein said means for establishing a pressure differential comprises a valve selectively positionable between a first position blocking said outlet channel and a second position wherein said outlet channel is open for dispensing liquid therefrom.

5. A liquid dispenser adapted for use with an applicator for applying liquid coatings comprising:

a first generally tubular housing having a closed end and an open end;

a second generally tubular housing slidably received within said open end of said first housing, said second housing having a fluid discharge channel;

sealing means for providing a liquid tight seal between said first and second housings, said first and second housing defining a liquid reservoir;

a one-way valve means disposed in said first housing at said closed end thereof for preventing liquid flow from said reservoir and adapted to receive a fill tube to fill said reservoir;

valve means positionable in said discharge channel, said valve means having a normally open position allowing fluid flow through said channel and a second closed position upon selective actuation thereof to block said channel.

6. Apparatus for dispensing liquids to an applicator for applying liquid coatings comprising:

a first generally tubular housing;

a second generally tubular housing slidably received within said first housing;

means for providing a liquid tight seal between said first and second housing, said first and second housings defining a liquid reservoir;

said second housing having an outlet channel communicating with said reservoir for the dispensing of liquid to an applicator as said second housing slides axially within said first housing;

means for refilling said liquid reservoir comprising:

an inlet means in said second housing for providing fluid communication between an external fluid source and the reservoir;

valve means disposed in said inlet means;

a fill tube adapted to be inserted into said valve means, said fill tube connected to an external fluid source and providing fluid communication between said source and the reservoir;

said valve means preventing fluid flow through said inlet means when said fill tube is disconnected from said valve means;

means for establishing a pressure differential between the reservoir and the external fluid source whereby fluid is withdrawn from the source into the reservoir.

7. A liquid dispenser in accordance with claim 6 wherein said fill tube is connected to a lid sized to fit a liquid container.

8. A liquid dispenser in accordance with claim 6 wherein said valve means comprises a one-way check valve.

9. A liquid dispenser in accordance with claim 6 wherein said means for establishing a pressure differential comprises a valve selectively positionable between a first position closing the outlet channel in said second housing and a second position wherein said outlet channel is open.

10. An applicator for applying liquid coatings comprising:

a first generally tubular housing;

a second generally tubular housing slidably received within said first housing;

means for providing a liquid tight seal between said first and said second housings, said first and second housing defining a liquid reservoir, said second housing having an outlet channel communicating with said reservoir for the dispensing of liquid as said second housing slides axially within said first housing;

an applicator head attached to said second housing and in fluid communication with the outlet channel;

means for refilling said liquid reservoir comprising:

an inlet means in said second housing for providing fluid communication between an external fluid source and the reservoir and valve means disposed in said inlet means for preventing fluid flow through said inlet means when said refill means is not connected to the external source and for providing fluid communication between the reservoir and the external source when the external source is connected to said inlet means;

means for establishing a pressure differential between the reservoir and the external fluid source whereby fluid is withdrawn from the source into the reservoir.

11. An applicator for applying liquid coatings in accordance with claim 10 further comprising a fill tube adapted to be inserted into said valve means to provide fluid communication between the reservoir and the external fluid source, said valve means automatically blocking said inlet means and preventing fluid flow therethrough when said refill tube is removed from said valve means.

12. A liquid applicator in accordance with claim 11 wherein said fill tube is connected to a lid sized to fit a liquid container.

13. A liquid applicator in accordance with claim 12 wherein said means for establishing a pressure differential comprises a valve having first and second selectable positions, said valve in said first position closing the outlet channel, said valve in said second position leaving said outlet channel open and providing fluid communication between the reservoir and said applicator head.

* * * * *